US012642304B2

(12) United States Patent
Sun et al.

(10) Patent No.: US 12,642,304 B2
(45) Date of Patent: Jun. 2, 2026

(54) HEATING METHOD AND DEVICE FOR ATOMIZER, COMPUTER APPARATUS, AND STORAGE MEDIUM

(71) Applicant: SHENZHEN SMOORE TECHNOLOGY LIMITED, Shenzhen (CN)

(72) Inventors: Changwen Sun, Shenzhen (CN); Weiming Fang, Shenzhen (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 916 days.

(21) Appl. No.: 17/839,814

(22) Filed: Jun. 14, 2022

(65) Prior Publication Data

US 2022/0304393 A1 Sep. 29, 2022

Related U.S. Application Data

(63) Continuation of application No. PCT/CN2020/121019, filed on Oct. 15, 2020.

(30) Foreign Application Priority Data

Dec. 17, 2019 (CN) ..... 201911298724.8

(51) Int. Cl.
*A24F 40/57* (2020.01)
*A24F 40/53* (2020.01)

(52) U.S. Cl.
CPC ..... *A24F 40/57* (2020.01); *A24F 40/53* (2020.01)

(58) Field of Classification Search
CPC ..... A24F 40/57; H05B 2203/021
See application file for complete search history.

(56) References Cited

U.S. PATENT DOCUMENTS 11,918,051 B2 * 3/2024 Huang ..... A24F 40/60
2014/0014126 A1 1/2014 Peleg et al.
(Continued)

FOREIGN PATENT DOCUMENTS

CN 101413768 A 4/2009
CN 102563884 A 7/2012
(Continued)

OTHER PUBLICATIONS

Patent Cooperation Treaty, International Search Report, International Application No. PCT/CN2020/121019 (Jan. 14, 2021).
(Continued)

*Primary Examiner* — Ibrahime A Abraham
*Assistant Examiner* — Hamzeh Hicham Amin
(74) *Attorney, Agent, or Firm* — Leydig, Voit & Mayer, Ltd.

(57) ABSTRACT

A method for heating a vaporizer includes: obtaining, in real time at a current moment, a sampling value of a thermal property of a heating element in the vaporizer upon detecting a trigger operation; determining whether the vaporizer reaches thermal equilibrium according to the sampling value obtained based on the current moment; upon determining that the vaporizer reaches thermal equilibrium, taking the sampling value of the thermal property of the heating element as a stable value, controlling a difference value between the sampling value of the heating element and the stable value to be within a first range, and obtaining, in real time, a first output power of the vaporizer; and stopping heating the heating element when the first output power is less than a first power threshold.

17 Claims, 6 Drawing Sheets

(56) References Cited

U.S. PATENT DOCUMENTS

| | | | |
|---|---|---|---|
| 2016/0309780 | A1 | 10/2016 | Chen et al. |
| 2017/0219238 | A1 | 8/2017 | Kibo |
| 2019/0247606 | A1 | 8/2019 | Williams |

FOREIGN PATENT DOCUMENTS

| | | | | | |
|---|---|---|---|---|---|
| CN | 103699152 | A | | 4/2014 | |
| CN | 104005215 | A | | 8/2014 | |
| CN | 104305527 | A | | 1/2015 | |
| CN | 104323428 | A | | 2/2015 | |
| CN | 104770884 | A | | 7/2015 | |
| CN | 106136323 | A | | 11/2016 | |
| CN | 107440157 | A | | 12/2017 | |
| CN | 108391852 | A | | 8/2018 | |
| CN | 108576933 | A | | 9/2018 | |
| CN | 108835718 | A | | 11/2018 | |
| CN | 108851233 | A | | 11/2018 | |
| CN | 108954631 | A | | 12/2018 | |
| CN | 109330032 | A | | 2/2019 | |
| CN | 109588779 | A | * | 4/2019 | ..... A24F 47/008 |
| CN | 109588785 | A | | 4/2019 | |
| CN | 109717519 | A | | 5/2019 | |
| CN | 109875132 | A | | 6/2019 | |
| CN | 110487848 | A | | 11/2019 | |
| CN | 110522079 | A | | 12/2019 | |
| CN | 110543112 | A | | 12/2019 | |
| CN | 110558617 | A | | 12/2019 | |
| CN | 110584204 | A | | 12/2019 | |
| CN | 111165914 | A | | 5/2020 | |
| DE | 202012008743 | U1 | | 10/2012 | |
| EP | 2984948 | A1 | | 2/2016 | |
| TW | M570400 | U | | 11/2018 | |
| WO | 2016017643 | A1 | | 2/2016 | |

OTHER PUBLICATIONS

Patent Cooperation Treaty, Written Opinion of the International Searching Authority, International Application No. PCT/CN2020/121019 (Jan. 14, 2021).

Chinese Patent Office, First Office Action in Chinese Patent Application No. 201911298724.8 (Mar. 16, 2021).

Chinese Patent Office, Notice of Registration and Notification to Grant Patent Right in Chinese Patent Application No. 201911298724.8 (Sep. 3, 2021).

Chinese Patent Office, First Office Action in Chinese Patent Application No. 201911298723.3 (Sep. 3, 2021).

Chinese Patent Office, Notice of Registration and Notification to Grant Patent Right in Chinese Patent Application No. 201911298723.3 (Apr. 28, 2022).

Guoyong Xie et al., "Temperature Variation Characteristics of Electronic Cigarettes During Atomization," Tobacco Technology, pp. 40-45, Jul. 31, 2018.

Kelly S. Schweitzer et al., "Endothelial Disruptive Proinflammatory Effects of Nicotine and E-Cigarette Vapor Exposures," Nicotine-Induced Signaling in Lung Endothelial Cells, L175-187, First Published May 15, 2015.

* cited by examiner

HEATING METHOD AND DEVICE FOR ATOMIZER, COMPUTER APPARATUS, AND STORAGE MEDIUM

CROSS-REFERENCE TO PRIOR APPLICATION

This application is a continuation of International Patent Application No. PCT/CN2020/121019, filed on Oct. 15, 2020, which claims priority to Chinese Patent Application No. CN 201911298724.8, filed on Dec. 17, 2019. The entire disclosure of both applications is hereby incorporated by reference herein.

FIELD

This application relates to the field of vaporizer technologies, and in particular, to a method and an apparatus for heating a vaporizer, a computer device, and a storage medium.

BACKGROUND

With the development of society, various vaporizers have emerged, such as humidifiers, electronic cigarettes, and medical vaporizers. A conventional method for heating a vaporizer is usually to add a material to be heated such as liquid or solid into the vaporizer and heat to vaporize the material to be heated.

However, for the conventional method for heating the vaporizer, when the material to be heated in the vaporizer is insufficient, the temperature of the vaporizer rises sharply, so that the vaporizer is likely to be dry-burned, resulting in a short service life of the vaporizer.

SUMMARY

In an embodiment, the present invention provides a method for heating a vaporizer, comprising: obtaining, in real time at a current moment, a sampling value of a thermal property of a heating element in the vaporizer upon detecting a trigger operation; determining whether the vaporizer reaches thermal equilibrium according to the sampling value obtained based on the current moment; upon determining that the vaporizer reaches thermal equilibrium, taking the sampling value of the thermal property of the heating element as a stable value, controlling a difference value between the sampling value of the heating element and the stable value to be within a first range, and obtaining, in real time, a first output power of the vaporizer; and stopping heating the heating element when the first output power is less than a first power threshold.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Figure 1:
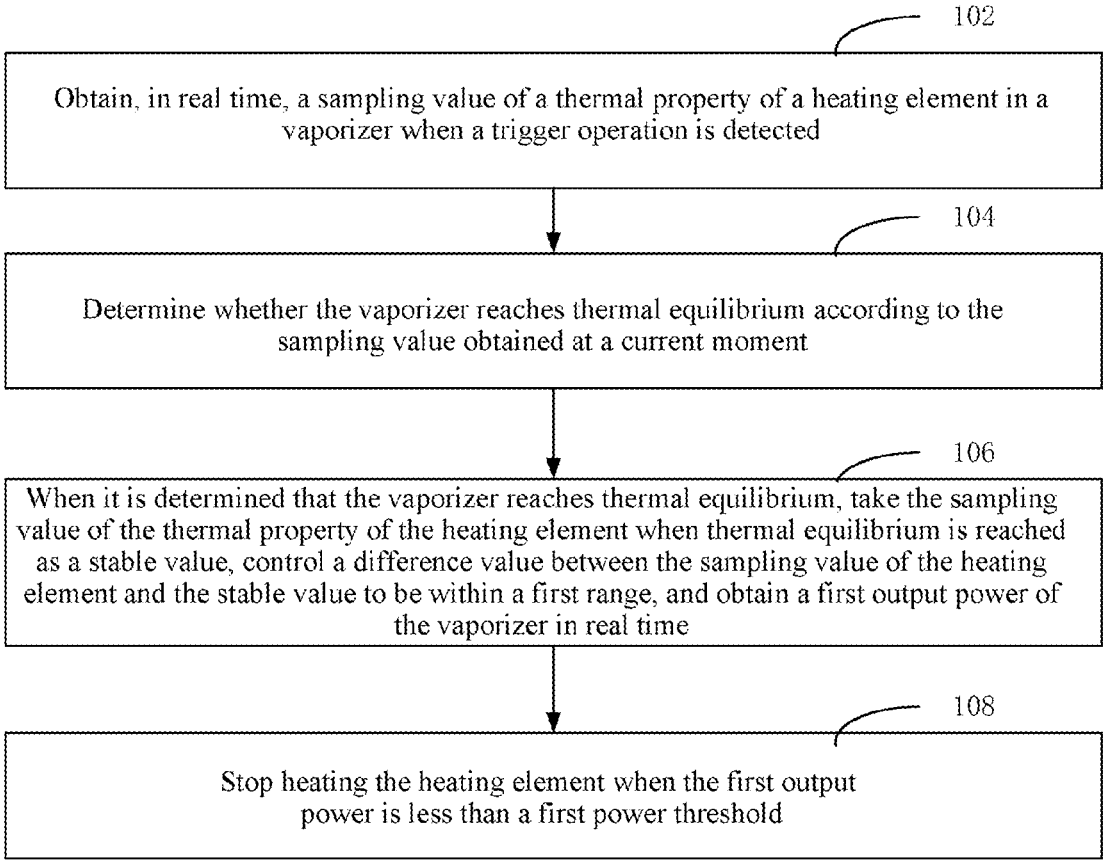
FIG. 1 is a schematic flow chart of a method for heating a vaporizer in an embodiment.

According to various embodiments of the present application, a method and an apparatus for heating a vaporizer, a computer device, and a storage medium that can extend the service life are provided.

A method for heating a vaporizer is provided, including:

obtaining, in real time, a sampling value of the thermal property of the heating element in the vaporizer upon detecting a trigger operation;

determining whether the vaporizer reaches thermal equilibrium according to the sampling value obtained based on the current moment;

upon determining that the vaporizer reaches thermal equilibrium, taking the sampling value of the thermal property of the heating element as a stable value when thermal equilibrium is reached, controlling the difference value between the sampling value of the heating element and the stable value to be within a first range, and obtaining, in real time, a first output power of the vaporizer; and stopping heating the heating element when the first output power is less than a first power threshold.

In an embodiment, the determining whether the vaporizer reaches thermal equilibrium according to the sampling value obtained at the current moment includes:

obtaining, based on the current moment, sampling values in a first duration, the first duration including the current moment; and determining that the vaporizer reaches thermal equilibrium when each of the sampling values in the first duration conforms to a first predetermined rule.

In an embodiment, the first predetermined rule is that each of the sampling values in the first duration is the same; or the first predetermined rule is that the difference values between any two of the sampling values in the first duration are within a preset range.

In an embodiment, the method further includes:

obtaining sampling values in a second duration when each of the sampling values in the first duration does not conform to the first predetermined rule, the second duration being greater than the first duration, and the second duration including the current moment; and determining that the vaporizer reaches a thermal equilibrium when each of the sampling values in the second duration conforms to a second predetermined rule.

In an embodiment, the second predetermined rule is that the sampling values in the second duration increase one by one in a time order, and the maximum difference value among difference values between two adjacent sampling values in the second duration is less than a difference value threshold; or the second predetermined rule is that the sampling values in the second duration increases one by one in a time order before becoming constant.

In an embodiment, prior to the taking the sampling value of the heating element as the stable value when thermal equilibrium is reached upon determining that the vaporizer reaches thermal equilibrium, the method further includes:

obtaining a trigger increment value of a last trigger operation, and a maximum value of the thermal property of the heating element in the last trigger operation;

determining, in real time, the first difference value between the sampling value and the maximum value of the thermal property of the heating element in the last trigger operation;

when the first difference value is greater than the trigger increment value, obtaining a reference value, controlling the difference value between the sampling value of the thermal property of the heating element and the reference value to be within a second range, and obtaining, in real time, a second output power of the vaporizer, the reference value being less than or equal to the maximum value of the thermal property of the heating element in the last trigger operation; and stopping heating the heating element when the second output power is less than a second power threshold.

In an embodiment, obtaining the maximum value of the thermal property of the heating element in the last trigger operation includes: obtaining the stable values of the thermal property of the heating element for individual trigger operations; and taking the maximum stable value among the stable values as the maximum value of the thermal property of the heating element in the last trigger operation.

In an embodiment, the reference value is one of the minimum value of the thermal property of the heating element in the last trigger operation, the average value of the thermal property of the heating element in the last trigger operation, or the maximum value of the thermal property of the heating element in the last trigger operation.

In an embodiment, the obtaining the trigger increment value of the last trigger operation includes:

obtaining the initial value of the last trigger operation, and the stable value of the last trigger operation; and determining the trigger increment value of the last trigger operation according to the initial value of the last trigger operation and the stable value of the last trigger operation.

In an embodiment, the method further includes:

obtaining a reference stable value and a reference protection trigger value, the reference protection trigger value being a threshold of the thermal property of the heating element;

determining a target parameter according to the reference stable value and the reference protection trigger value;

the determining the trigger increment value of the last trigger operation according to the initial value of the last trigger operation and the stable value of the last trigger operation including:

determining the trigger increment value of the last trigger operation according to the target parameter, the initial value of the last trigger operation, and the stable value of the last trigger operation.

In an embodiment, the obtaining the initial value of the last trigger operation includes:

obtaining a calibration value;

taking a sampling value of the last trigger operation as the initial value of the last trigger operation when the sampling value of the last trigger operation is less than the calibration value; and taking the calibration value as the initial value of the last trigger operation when the sampling value of the last trigger operation is greater than or equal to the calibration value.

In an embodiment, the thermal property of the heating element is a resistance value of the heating element or a temperature of the heating element.

In an embodiment, the trigger operation is an inhalation operation, a press operation, a click operation, or a slide operation.

In an embodiment, the stopping heating the heating element when the first output power is less than the first power threshold includes:

upon detecting that the first output power is less than the first power threshold, cutting off the power supply of the vaporizer to stop the vaporizer from heating the heating element; or upon detecting that the first output power is less than the first power threshold, cutting off the power supply of the heating element to stop heating the heating element.

In an embodiment, the method further includes:

upon determining that the vaporizer does not reach thermal equilibrium, when the current trigger operation is not the first trigger operation, obtaining a trigger increment value; when the first difference value is less than or equal to the trigger increment value, determining a reference value and obtaining a second output power; when the second output power is less than a second power threshold, stopping heating the heating element.

An apparatus for heating a vaporizer is provided, including:

a sampling value obtaining module, configured to obtain, in real time, a sampling value of the thermal property of the heating element in the vaporizer upon detection of a trigger operation;

a thermal equilibrium determining module, configured to determine whether the vaporizer reaches thermal equilibrium according to the sampling value obtained based on the current moment;

a first output power obtaining module, configured to, upon determination that the vaporizer reaches thermal equilibrium, take the sampling value of the thermal property of the heating element as a stable value when thermal equilibrium is reached, control the difference value between the sampling value of the heating element and the stable value to be within a first range, and obtain, in real time, a first output power of the vaporizer; and a heating stopping module, configured to stop heating the heating element when the first output power is less than a first power threshold.

A computer device is provided, including a memory and a processor. The memory stores a computer program, and the processor implements steps of the method upon execution of the computer program.

A computer-readable storage medium is provided, which has a computer program stored thereon, and the computer program, when executed by a processor, implements steps of the method.

The details of one or more embodiments of the present application are set forth in the accompanying drawings and the description below. Other features, objects, and advantages of the present application will be apparent from the description and drawings, and from the claims.

The description of several embodiments of the application is relatively specific and detailed, but it should not be construed as a limitation on the scope of the patent application. It should be noted that, for those skilled in the art, without departing from the concept of the present application, several modifications and improvements can be made, which all belong to the protection scope of the present application. Therefore, the scope of protection of the patent of the present application shall be subject to the appended claims.

To make the objectives, technical solutions, and advantages of this application clearer, the following further describes this application in detail with reference to the accompanying drawings and the embodiments. It is to be understood that the specific embodiments described herein are only used for explaining this application, and are not used for limiting this application.

In an embodiment, as shown in FIG. 1, a method for heating a vaporizer is provided, including the following steps.

At step 102, a sampling value of the thermal property of the heating element in the vaporizer is obtained in real time when a trigger operation is detected.

The vaporizer refers to a device that heats a material to be heated and thereby vaporizes the material to be heated. The material to be heated may be either liquid or solid. The vaporizer, such as an electronic cigarette, heats e-liquid through the electronic cigarette to form smoke. The vaporizer may alternatively be a humidifier, a medical vaporizer, or the like.

The vaporizer includes a heating element through which the material to be heated can be heated. The thermal property of the heating element may be the resistance value of the heating element or the temperature of the heating element.

The trigger operation may be, but is not limited to, an inhalation operation, a press operation, a click operation, a slide operation, or the like. For example, when the vaporizer is an electronic cigarette, the trigger operation may be an inhalation operation. It is indicated that an inhalation operation is detected when an air pressure sensor in the vaporizer detects a change in air pressure.

Real-time refers to responding in a short time. Specifically, a preset duration may be obtained, and when a trigger operation is detected, a sampling value of the thermal property of the heating element in the vaporizer is obtained at an interval of the preset duration. For example, the preset duration is 200 milliseconds. That is, when a trigger operation is detected, a sampling value of the thermal property of the heating element in the vaporizer is obtained every 200 milliseconds.

At step 104, whether the vaporizer reaches thermal equilibrium is determined according to the sampling value obtained based on the current moment.

It can be understood that when the vaporizer reaches thermal equilibrium, the energy inputted to the vaporizer is the same as the energy outputted from the vaporizer, and the material to be heated in the vaporizer can be heated for continuous and stable vaporization.

At step 106, when it is determined that the vaporizer reaches thermal equilibrium, the sampling value of the thermal property of the heating element is taken as a stable value when thermal equilibrium is reached, the difference value between the sampling value of the heating element and the stable value is controlled to be within a first range, and a first output power of the vaporizer is obtained in real time. When the vaporizer reaches thermal equilibrium, the difference value between the sampling value of the heating element and the stable value is controlled to be within the first range, so that the energy absorbed by the heating element can be stabilized within a certain range.

In an embodiment, a proportion integral differential (PID) algorithm may be used to compare the sampling value of the heating element with the stable value, so as to determine the difference value between the sampling value of the heating element and the stable value, and control the power of the heating element according to the difference value, so that the sampling value of the heating element is adjusted to the stable value, that is, the material to be heated is heated at a constant temperature. The PID algorithm forms the control deviation according to a given value and an actual output value, and forms the control amount by proportioning, integrating, and differentiating the deviation through linear combination, to control a to-be-controlled object. A general PID controller acts as a linear controller.

It can be understood that the vaporizer, through heat generation of the heating element, provides energy, that is, a first total energy, of which one part is absorbed by the heating element itself and the other part is absorbed by the material to be heated in the vaporizer. Therefore, the first total energy is a sum of the energy absorbed by the heating element and the energy absorbed by the material to be heated in the vaporizer.

The first total energy can be obtained by calculation using the following formula: $Qp=Qr+Qoil$. $Qp$ is the first total energy, $Qr$ is the energy absorbed by the heating element, and $Qoil$ is the energy absorbed by the material to be heated in the vaporizer. That is, according to the law of conservation of energy, it can be learned that one part of the heat generated by the heating element is absorbed by itself, causing the temperature to rise, and the other part is absorbed by the material to be heated, to vaporize the e-liquid. In a case that the constant temperature heating is adopted and the content of the material to be heated is normal, that is, the material to be heated can absorb heat stably, thermal equilibrium will be reached, and the first total energy outputted by the vaporizer, that is, the first output power, is stabilized at a value. When the content of the material to be heated is reduced, the first total energy outputted by the vaporizer, that is, the first output power, will be reduced. Therefore, it can be determined whether the content of the material to be heated in the vaporizer is normal according to the first output power.

At step 108, heating of the heating element is stopped when the first output power is less than a first power threshold. In an embodiment, when it is detected that the first output power is less than the first power threshold, the power supply of the vaporizer may be cut off, so that the vaporizer stops heating the heating element.

In another embodiment, when it is detected that the first output power is less than the first power threshold, the power supply of the heating element may be cut off to stop heating the heating element.

In the aforementioned method for heating the vaporizer, a sampling value of the thermal property of the heating element in the vaporizer is obtained in real time when a trigger operation is detected; whether the vaporizer reaches thermal equilibrium is determined according to the sampling value obtained based on the current moment; when it is determined that the vaporizer reaches thermal equilibrium, the sampling value of the thermal property of the heating element is taken as a stable value when thermal equilibrium is reached, the difference value between the sampling value of the heating element and the stable value is controlled to be within a first range, and a first output power of the vaporizer is obtained in real time; the difference value between the sampling value of the heating element and the stable value is controlled to be within the first range, that is, the energy absorbed by the heating element is controlled to be stable within a certain range; and the first output power is less than a first power threshold, indicating that the energy absorbed by a material to be heated in the vaporizer decreases, in other words, the material to be heated in the vaporizer, that is, an object heated for vaporization, is insufficient, so the heating of the heating element is stopped, which prevents the dry burning of the vaporizer, and extends the service life of the vaporizer.

In an embodiment, the determining whether the vaporizer reaches thermal equilibrium according to the sampling value obtained at the current moment includes: obtaining, based on the current moment, sampling values in a first duration, the first duration including the current moment; and determining that the vaporizer reaches thermal equilibrium when each of the sampling values in the first duration conforms to a first predetermined rule.

The first duration may be set according to the needs of a user.

In an embodiment, the first predetermined rule may be that each sampling value in the first duration is the same. For example, if the current moment is 19:05:10.020 (hour/minute/second/millisecond, precise to milliseconds), and the vaporizer obtains a sampling value of the thermal property of the heating element in the vaporizer every 200 milliseconds, the first duration may be an integer multiple of 200 milliseconds, such as 600 milliseconds, and four sampling values can be obtained from 19:05:10.020 to 19:05:10.620. When the four sampling values are the same, it can be determined that the vaporizer reaches thermal equilibrium.

In another embodiment, the first predetermined rule may also be that the difference values between any two of the sampling values in the first duration are within a preset range. For example, if the current moment is 19:05:10.020, and the vaporizer obtains a sampling value of the thermal property of the heating element in the vaporizer every 200 milliseconds, the first duration may be an integer multiple of 200 milliseconds, such as 600 milliseconds, and four sampling values can be obtained from 19:05:10.020 to 19:05:10.620, which are respectively 578, 579, 580, and 578. If the preset range is 10, the difference values between any two of the sampling values in the first duration are within the preset range, and it can be determined that the vaporizer reaches thermal equilibrium.

In this embodiment, by obtaining sampling values in the first duration at the current moment, when the sampling values in the first duration conform to the first rule, it can be more accurately determined that the vaporizer has reached thermal equilibrium.

In an embodiment, the method further includes: obtaining sampling values in a second duration when each of the sampling values in the first duration does not conform to the first predetermined rule, the second duration being greater than the first duration, and the second duration including the current moment; and determining that the vaporizer reaches thermal equilibrium when each of the sampling values in the second duration conforms to a second predetermined rule.

The second predetermined rule may be set according to the needs of the user.

In an embodiment, the second predetermined rule may be that the sampling values in the second duration increase one by one in a time order, and the maximum difference value among difference values between two adjacent sampling values in the second duration is less than a difference value threshold.

In another embodiment, the second predetermined rule may also be that the sampling values in the second duration increase one by one in a time order before becoming constant.

In an embodiment, the method further includes: obtaining sampling values in a second duration when the sampling values in the first duration are different, the second duration being greater than the first duration, and the second duration including the current moment; obtaining the difference value between two adjacent sampling values in the second duration when the sampling values in the second duration increase one by one in a time order; determining the maximum difference value from the difference values; and determining that the vaporizer reaches thermal equilibrium, when the maximum difference value is less than a difference value threshold.

The second duration may be set according to the needs of the user and the second duration is greater than the first duration. For example, the current moment is 19:05:10.020, and the vaporizer obtains a sampling value of the thermal property of the heating element in the vaporizer every 200 milliseconds. When the sampling values in the first duration are different, sampling values in the second duration are obtained. The second duration may also be an integer multiple of 200 milliseconds, such as 800 milliseconds, so that five sampling values can be obtained from 19:05:10.020 to 19:05:10.820, which are respectively 210, 220, 235, 240, 252, and 260. The sampling values in the second duration of 800 milliseconds increase one by one in a time order, and the difference values each between two adjacent sampling values are determined to be 10, 15, 5, 12, and 8. If a difference value threshold is 20, the maximum difference value 15 is less than the difference value threshold 20, and it is determined that the vaporizer reaches thermal equilibrium.

In this embodiment, when the sampling values in the first duration are different, sampling values in the first duration are obtained. When the sampling values in the second duration increase one by one in a time order, and the maximum difference value between two adjacent sampling values is less than the threshold, it is indicated that the vaporizer is in a stable state, and it can be more accurately determined that the vaporizer reaches thermal equilibrium.

In another embodiment, when the sampling values in the first duration are different, sampling values in a second duration are obtained, the second duration being greater than the first duration, and the second duration including the current moment; and it is determined that the vaporizer reaches thermal equilibrium when the sampling values in the second duration increase one by one in a time order before becoming constant.

When the sampling values in the second duration increase one by one in a time order before becoming constant, data of two stages of before reaching thermal equilibrium and after reaching thermal equilibrium are included in the second duration. When the sampling value becomes constant, the vaporizer has reached thermal equilibrium.

In this embodiment, when the sampling values in the first duration are different, sampling values in the second duration are obtained. When the sampling values in the second duration conform to the second predetermined rule, it is indicated that the vaporizer reaches thermal equilibrium from no thermal equilibrium, and it can be more accurately determined that the vaporizer has reached thermal equilibrium.

Figure 2:
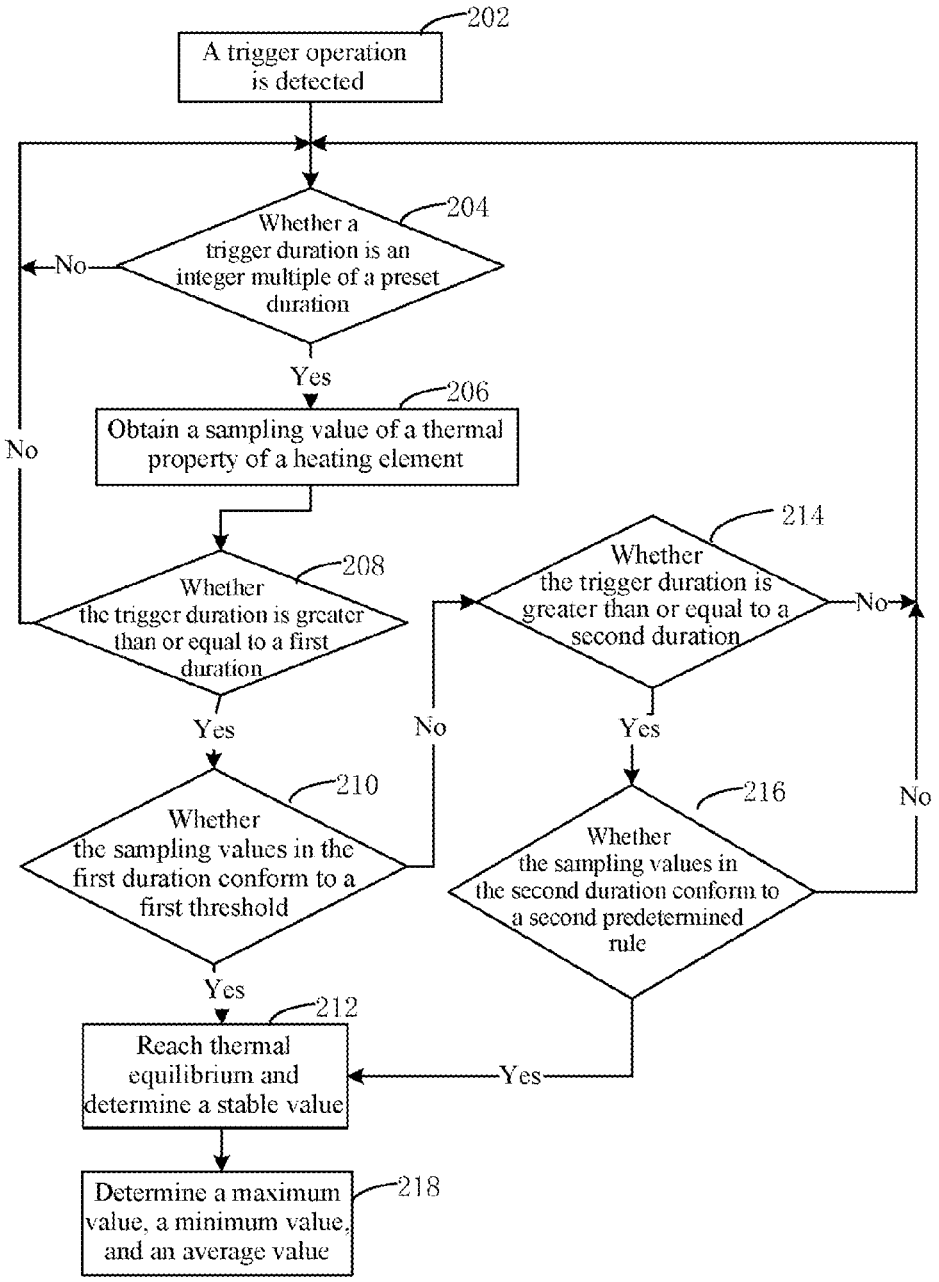
FIG. 2 is a schematic flow chart of determining a stable value, a maximum value, a minimum value, and an average value after a trigger operation of a vaporizer in an embodiment.

In an embodiment, as shown in FIG. 2, when a trigger operation is detected in step 202, the sampling value of the thermal property of the heating element in the vaporizer is obtained in real time, that is, step 204 and step 206 are performed, to determine whether a trigger duration is an integer multiple of a preset duration, obtain the sampling value of the thermal property of the heating element when it is determined that the trigger duration is an integer multiple of the preset duration, and continue to perform step 204 when it is determined that the trigger duration is not an integer multiple of the preset duration. The trigger duration refers to a duration between the current moment and the moment of the trigger operation.

Step 208 is performed to determine whether the trigger duration is greater than or equal to the first duration; when it is determined that the trigger duration is greater than or equal to the first duration, step 210 is performed to determine whether the sampling values in the first duration conform to the first predetermined rule; and when it is determined that the sampling values in the first duration conform to the first predetermined rule, step 212 is performed to determine a stable value when the vaporizer reaches thermal equilibrium. When it is determined that the trigger duration is less than the first duration, step 204 is performed. When the sampling values in the first duration do not conform to the first predetermined rule, step 214 is performed to determine whether the trigger duration is greater than or equal to the second duration; when it is determined that the trigger duration is greater than or equal to the second duration, step 216 is performed to determine whether the sampling values in the second duration conform to the second predetermined rule; and when it is determined that the sampling values in the second duration conform to the second predetermined rule, step 212 is performed to determine a stable value when the vaporizer reaches thermal equilibrium.

When the trigger duration is less than the second duration, step 204 is performed. When it is determined that the difference value between two adjacent sampling values is greater than a difference value threshold, step 204 is performed. When the vaporizer reaches thermal equilibrium, step 218 may be performed to determine the maximum value, the minimum value, and the average value of the thermal property of the heating element.

Figure 3:
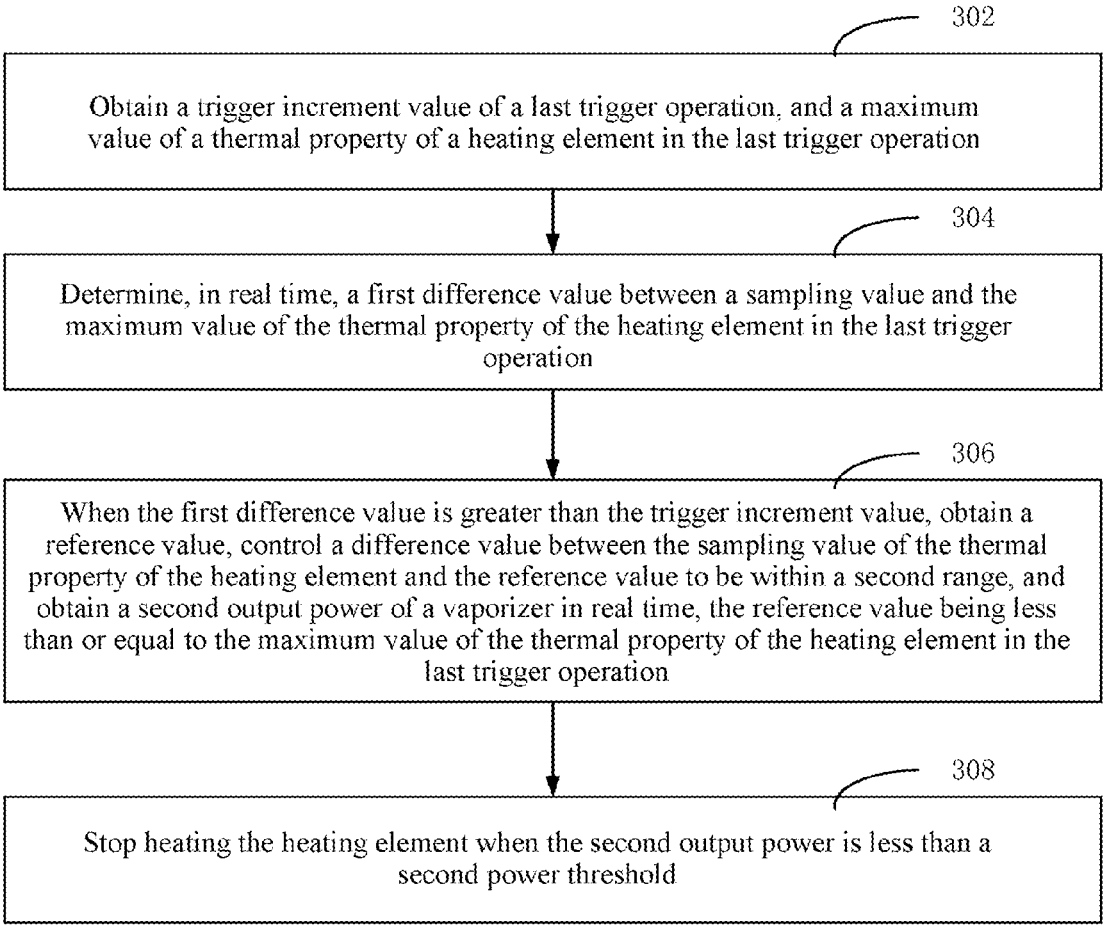
FIG. 3 is a schematic flow chart of a heating method before a vaporizer reaches thermal equilibrium in an embodiment.

In an embodiment, as shown in FIG. 3, prior to taking the sampling value of the heating element as the stable value when thermal equilibrium is reached when it is determined that the vaporizer reaches thermal equilibrium, the method further includes the following steps.

At step 302, a trigger increment value of a last trigger operation, and a maximum value of the thermal property of the heating element in the last trigger operation are obtained.

In an embodiment, obtaining the maximum value of the thermal property of the heating element in the last trigger operation includes: obtaining the stable values of the thermal property of the heating element for individual trigger operations; and taking the maximum stable value among the stable values as the maximum value of the thermal property of the heating element in the last trigger operation.

During each trigger operation, when the vaporizer reaches thermal equilibrium, a sampling value of the thermal property of the heating element when the vaporizer reaches thermal equilibrium is obtained and recorded, and the sampling value is taken as a stable value of this trigger operation. The stable values recorded during and before the last trigger operation are obtained, the stable values are compared with each other, and the maximum stable value is taken as the maximum value of the thermal property of the heating element in the last trigger operation.

In an example, before the current trigger operation, there are four trigger operations, the stable value in a first trigger operation is 220, the stable value in a second trigger operation is 230, the stable value in a third trigger operation is 210, and the stable value in a fourth trigger operation, that is, the last trigger operation, is 235, so that the maximum value of the thermal property of the heating element in the last trigger operation is 235.

In another example, before the current trigger operation, there are four trigger operations, the stable value in a first trigger operation is 220, the stable value in a second trigger operation is 230, the stable value in a third trigger operation is 210, and the stable value in a fourth trigger operation, that is, the last trigger operation, is 213, so that the maximum value of the thermal property of the heating element in the last trigger operation is 230.

In an embodiment, when the vaporizer reaches thermal equilibrium, the stable value of the thermal property of the heating element in the current trigger operation is compared with the maximum value of the thermal property of the heating element in the last trigger operation, and the greater of the two is taken as the maximum value of the thermal property of the heating element in the current trigger operation.

When the current trigger operation is a first trigger operation, the stable value of the thermal property of the heating element in the current trigger operation is taken as the maximum value of the thermal property of the heating element in the current trigger operation.

For example, when the vaporizer reaches thermal equilibrium during the first trigger operation, a stable value S_stable1 of the thermal property of the heating element is obtained, and S_stable1 is taken as a maximum value S_max of the thermal property of the heating element in the first trigger operation; and when the vaporizer reaches thermal equilibrium during a second trigger operation, a stable value S_stable2 of the thermal property of the heating element is obtained, when S_stable2 is greater than S_stable1, S_stable2 is taken as a maximum value S_max of the thermal property of the heating element in the second trigger operation, when S_stable2 is less than or equal to S_stable1, S_stable1 is taken as the maximum value S_max of the thermal property of the heating element in the second trigger operation, and so on.

At step 304, the first difference value between the sampling value and the maximum value of the thermal property of the heating element in the last trigger operation is determined in real time.

The first difference value is the difference value between the sampling value of the thermal property of the heating element before the vaporizer reaches thermal equilibrium and the maximum value of the thermal property of the heating element in the last trigger operation.

After the maximum value of the thermal property of the heating element in the last trigger operation is obtained, the first difference value between the obtained sampling value of the thermal property of the heating element in the vaporizer and the obtained maximum value of the thermal property of the heating element in the last trigger operation is determined in real time.

At step 306, when the first difference value is greater than the trigger increment value, a reference value is obtained, the difference value between the sampling value of the thermal property of the heating element and the reference value is controlled to be within a second range, and a second output power of the vaporizer is obtained in real time, the reference value being less than or equal to the maximum value of the thermal property of the heating element in the last trigger operation.

The reference value is less than or equal to the maximum value of the thermal property of the heating element in the last trigger operation. For example, the reference value may be one of the minimum value of the thermal property of the heating element in the last trigger operation, the average value of the thermal property of the heating element in the last trigger operation, or the maximum value of the thermal property of the heating element in the last trigger operation. The reference value may alternatively be other values set by the user as needed, which is not limited thereto.

The difference value between the sampling value of the heating element and the reference value is controlled to be within a second range before the vaporizer reaches thermal equilibrium, so that the energy absorbed by the heating element can be stabilized within a certain range. The second range may be the same as the first range or may be different from the first range.

When the first difference value is greater than the trigger increment value, it is indicated that the sampling value of the thermal property of the heating element in the vaporizer exceeds a threshold, thus obtaining the reference value and controlling the difference value between the sampling value of the thermal property of the heating element and the reference value to be within the second range.

In an embodiment, a proportion integral differential (PID) algorithm may be used to compare the sampling value of the heating element with the reference value, so as to determine the difference value between the sampling value of the heating element and the reference value, and control the power of the heating element according to the difference value, so that the sampling value of the heating element is adjusted to the reference value.

It can be understood that, before the vaporizer reaches thermal equilibrium, the vaporizer, through heat generation of the heating element, provides energy, that is, a second output power, also a second total energy, of which one part is absorbed by the heating element itself and the other part is absorbed by the material to be heated in the vaporizer. Therefore, the second total energy is a sum of the energy absorbed by the heating element and the energy absorbed by the material to be heated in the vaporizer.

The second total energy can be obtained by calculation using the following formula: $Qp=Qr+Qoil$. Qp is the second total energy, Qr is the energy absorbed by the heating element, and Qoil is the energy absorbed by the material to be heated in the vaporizer.

At step 308, heating of the heating element is stopped when the second output power is less than a second power threshold.

The difference value between the sampling value of the heating element and the reference value is controlled to be within the second range before the vaporizer reaches thermal equilibrium, so that the energy absorbed by the heating element can be stabilized within a certain range. When the second output power is less than the second power threshold, it is indicated that the energy absorbed by the material to be heated in the vaporizer is reduced, that is, the material to be heated in the vaporizer is reduced, so the heating of the heating element is stopped.

In an embodiment, when it is detected that the second total energy is less than the second power threshold, the power supply of the vaporizer may be cut off, so that the vaporizer stops heating the heating element.

In another embodiment, when it is detected that the second total energy is less than the second power threshold, the power supply of the heating element may be cut off to stop heating the heating element.

In this embodiment, before the vaporizer reaches thermal equilibrium, the trigger increment value of the last trigger operation and the maximum value of the thermal property of the heating element in the last trigger operation are obtained: the first difference value between the sampling value and the maximum value of the thermal property of the heating element in the last trigger operation is determined in real time; when the first difference value is greater than the trigger increment value, the reference value is obtained, the difference value between the sampling value of the thermal property of the heating element and the reference value is controlled to be within the second range, and the outputted second output power is obtained in real time; the difference value between the sampling value of the thermal property of the heating element and the reference value is controlled to be within the second range, that is, the energy absorbed by the heating element is controlled to be stable within a certain range; the second output power is less than a second power threshold, indicating that the energy absorbed by a material to be heated in the vaporizer decreases, in other words, the material to be heated in the vaporizer, that is, an object heated for vaporization, is insufficient, so the heating of the heating element is stopped, which prevents the dry burning of the vaporizer, and extends the service life of the vaporizer. Further, the method for heating the vaporizer introduces a process of self-learning, that is, a process of obtaining the stable value, whenever the trigger operation is detected, so that the trigger increment value is dynamically adjusted along with the operating of the vaporizer, and thus the vaporizer automatically adapts to a vaporization temperature range of the material to be heated, thereby ensuring that the vaporizer works accurately and stably.

It can be understood that, when the trigger operation is the first trigger operation, that is, the vaporizer does not include the maximum value of the thermal property of the heating element in the last trigger operation and the trigger increment value of the last trigger operation, a stable value after the vaporizer reaches thermal equilibrium and the first output power are determined.

In an embodiment, the vaporizer may be an electronic cigarette. When it is detected that a cartridge is inserted into the vaporizer, a step of obtaining the sampling value of the thermal property of the heating element in the vaporizer in real time is performed; and when it is detected that the cartridge is pulled out of the vaporizer, data stored in the vaporizer is cleared. The cartridge may be used to store a material to be heated, such as e-liquid.

Figure 4:
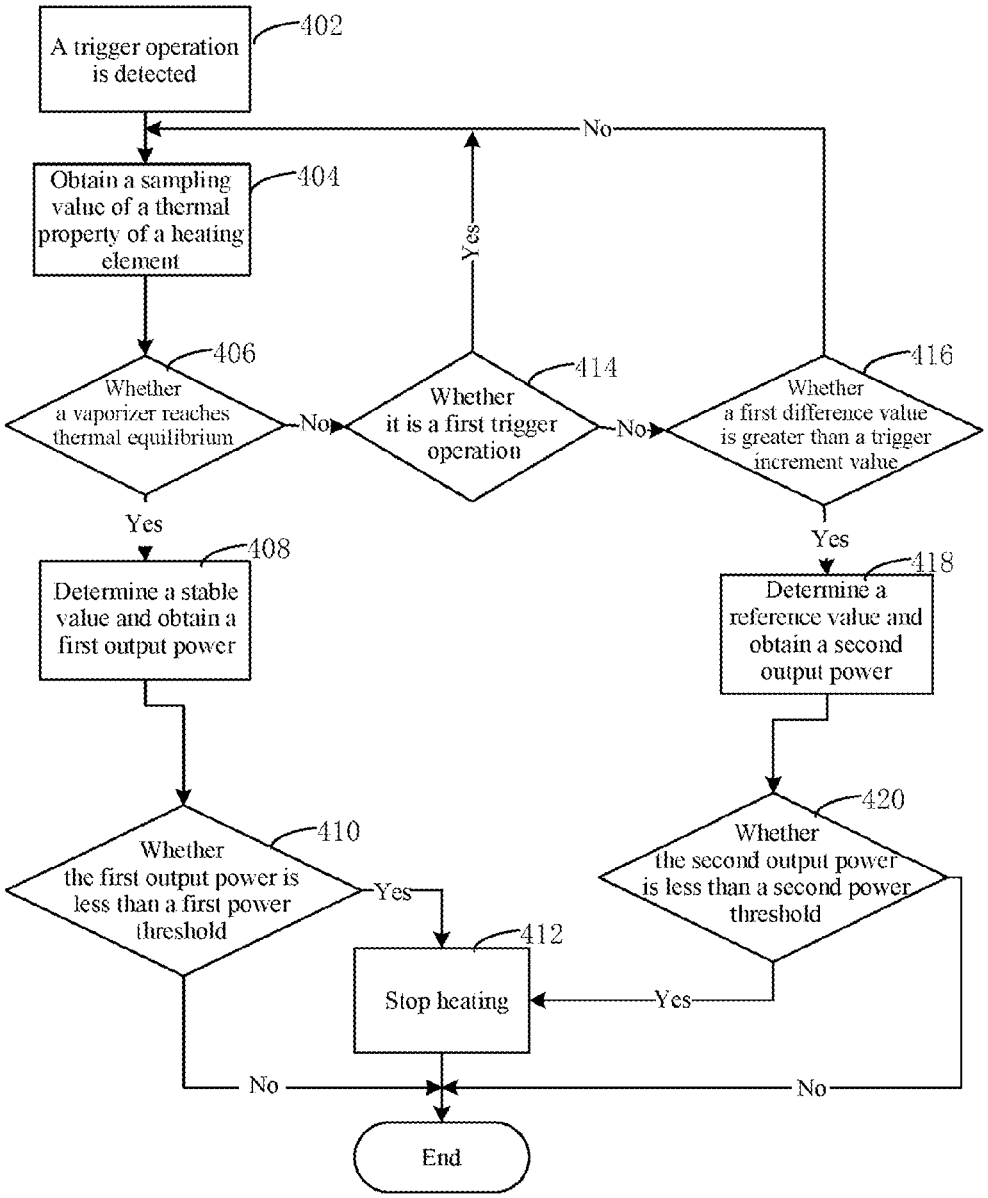
FIG. 4 is a schematic flow chart of a method for heating a vaporizer in another embodiment.

In an embodiment, as shown in FIG. 4, when a trigger operation is detected in step 402, step 404 is performed to obtain the sampling value of the thermal property of the heating element, and step 406 is performed according to the obtained sampling value to determine whether the vaporizer reaches thermal equilibrium. When it is determined that the vaporizer reaches thermal equilibrium, step 408 is performed to determine a stable value and obtain a first output power; step 410 is performed to detect whether the first output power is less than the first power threshold; when it is determined that the first output power is less than the first power threshold, step 412 is performed to stop heating the heating element; and when it is determined that the first output power is not less than the first power threshold, the process ends.

When it is determined that the vaporizer does not reach thermal equilibrium, step 414 is performed to determine whether the current trigger operation is the first trigger operation, and when the current trigger operation is the first trigger operation, step 404 is performed; when it is determined that the current trigger operation is not the first trigger operation, a trigger increment value is obtained, and step 416 is performed to determine whether the first difference value is greater than the trigger increment value, the first difference value being the difference value between the sampling value and the maximum value of the thermal property of the heating element in the last trigger operation; when it is determined that the first difference value is less than or equal to the trigger increment value, step 404 is performed; when it is determined that the first difference value is greater than the trigger increment value, step 418 is performed to determine a reference value and obtain a second output power; step 420 is performed to detect whether the second output power is less than a second power threshold; when it is determined that the second output power is less than a second power threshold, step 412 is performed to stop heating the heating element; and when it is determined that the second output power is not less than a second power threshold, the process ends.

In an embodiment, the reference value is one of the minimum value of the thermal property of the heating element in the last trigger operation, the average value of the thermal property of the heating element in the last trigger operation, or the maximum value of the thermal property of the heating element in the last trigger operation.

Obtaining the maximum value of the thermal property of the heating element in the last trigger operation includes: obtaining the stable values of the thermal property of the heating element for individual trigger operations; and taking the maximum stable value among the stable values as the maximum value of the thermal property of the heating element in the last trigger operation.

During each trigger operation, when the vaporizer reaches thermal equilibrium, a sampling value of the thermal property of the heating element when the vaporizer reaches thermal equilibrium is obtained and recorded, and the sampling value is taken as a stable value of this trigger operation. The stable values recorded during and before the last trigger operation are obtained, the stable values are compared with each other, and the maximum stable value is taken as the maximum value of the thermal property of the heating element in the last trigger operation.

In an example, before the current trigger operation, there are four trigger operations, the stable value in a first trigger operation is 220, the stable value in a second trigger operation is 230, the stable value in a third trigger operation is 210, and the stable value in a fourth trigger operation, that is, the last trigger operation, is 235, so that the maximum value of the thermal property of the heating element in the last trigger operation is 235.

In another example, before the current trigger operation, there are four trigger operations, the stable value in a first trigger operation is 220, the stable value in a second trigger operation is 230, the stable value in a third trigger operation is 210, and the stable value in a fourth trigger operation, that is, the last trigger operation, is 213, so that the maximum value of the thermal property of the heating element in the last trigger operation is 230.

In an embodiment, when the vaporizer reaches thermal equilibrium, the stable value of the thermal property of the heating element in the current trigger operation is compared with the maximum value of the thermal property of the heating element in the last trigger operation, and the greater of the two is taken as the maximum value of the thermal property of the heating element in the current trigger operation.

When the current trigger operation is a first trigger operation, the stable value of the thermal property of the heating element in the current trigger operation is taken as the maximum value of the thermal property of the heating element in the current trigger operation.

For example, when the vaporizer reaches thermal equilibrium during the first trigger operation, a stable value S_stable1 of the thermal property of the heating element is obtained, and S_stable1 is taken as a maximum value S_max of the thermal property of the heating element in the first trigger operation; and when the vaporizer reaches thermal equilibrium during a second trigger operation, a stable value S_stable2 of the thermal property of the heating element is obtained, when S_stable2 is greater than S_stable1, S_stable2 is taken as a maximum value S_max of the thermal property of the heating element in the second trigger operation, when S_stable2 is less than or equal to S_stable1, S_stable1 is taken as the maximum value S_max of the thermal property of the heating element in the second trigger operation, and so on.

Obtaining the minimum value of the thermal property of the heating element in the last trigger operation includes: obtaining the stable values of the thermal property of the heating element for individual trigger operations; and taking the minimum stable value among the stable values as the minimum value of the thermal property of the heating element in the last trigger operation.

During each trigger operation, when the vaporizer reaches thermal equilibrium, a sampling value of the thermal property of the heating element when the vaporizer reaches thermal equilibrium is obtained and recorded, and the sampling value is taken as a stable value of this trigger operation. The stable values recorded during and before the last trigger operation are obtained, the stable values are compared with each other, and the minimum stable value is taken as the minimum value of the thermal property of the heating element in the last trigger operation.

The average value of the thermal property of the heating element in the last trigger operation includes: obtaining the stable values of the thermal property of the heating element for individual trigger operations; and determining the average value based on the stable values, and taking the average value as the average value of the thermal property of the heating element in the last trigger operation.

The stable values of the thermal property of the heating element is obtained for individual trigger operations, the average value is acquired, and this average value is taken as the average value of the thermal property of the heating element in the last trigger operation.

When the last trigger operation is the first trigger operation, the stable value of the thermal property of the heating element in the last trigger operation is taken as the average value of the thermal property of the heating element in the last trigger operation.

Further, determining the average value of the thermal property of the heating element when the counted stable value reaches a threshold, can make this average value more accurate.

In an embodiment, the obtaining the trigger increment value of the last trigger operation includes: obtaining the initial value of the last trigger operation and the stable value of the last trigger operation; and determining the trigger increment value of the last trigger operation according to the initial value of the last trigger operation and the stable value of the last trigger operation.

The initial value of the last trigger operation may be a sampling value of the thermal property of the heating element in the vaporizer obtained for the first time when the last trigger operation is detected, may be the minimum sampling value among the obtained sampling values, or may be the second minimum value among the obtained sampling values, and is not limited thereto.

In an embodiment, during the current trigger operation, a trigger increment value of the current trigger operation can be determined, which is used to determine the second output power before the vaporizer reaches thermal equilibrium during a next trigger operation.

In an embodiment, the method further includes: obtaining a reference stable value and a reference protection trigger value, the reference protection trigger value being a threshold of the thermal property of the heating element; and determining a target parameter according to the reference stable value and the reference protection trigger value. The determining the trigger increment value of the last trigger operation according to the initial value of the last trigger operation and the stable value of the last trigger operation includes: determining the trigger increment value of the last trigger operation according to the target parameter, the initial value of the last trigger operation, and the stable value of the last trigger operation.

The reference stable value is a predicted empirical value when the vaporizer reaches thermal equilibrium. The reference protection trigger value is a predicted empirical threshold of the thermal property of the heating element in the vaporizer.

For example, when the vaporizer is an electronic cigarette, the material to be heated in the electronic cigarette is e-liquid. According to the characteristics of the e-liquid, when the e-liquid is vaporized and the vaporizer reaches thermal equilibrium, the sampling value of the thermal property of the heating element may be between 250° C. and 290° C., the reference stable value may be determined to be such as 270° C., and the reference protection trigger value may be 320° C., so that a value range of L value may be between 0.05 and 0.1.

Further, a candidate range of the target parameter may be obtained, a candidate parameter is determined according to the reference stable value and the reference protection trigger value, and when the candidate parameter is within the candidate range, the candidate parameter is taken as the target parameter.

For example, the determined candidate range may be between 0.05 and 0.1, and when the candidate parameter determined according to the reference stable value and the reference protection trigger value is between 0.05 and 0.1, the candidate parameter can be taken as the target parameter.

In this embodiment, the target parameter is determined according to the obtained reference stable value and the obtained reference protection trigger value, and a more accurate trigger increment value of the last trigger operation can be determined according to the target parameter, the initial value of the last trigger operation, and the stable value of the last trigger operation.

In an embodiment, the obtaining the initial value of the last trigger operation includes: obtaining a calibration value; taking the sampling value of the last trigger operation as the initial value of the last trigger operation when the sampling value of the last trigger operation is less than the calibration value; and taking the calibration value as the initial value of the last trigger operation when the sampling value of the last trigger operation is greater than or equal to the calibration value.

The initial value of the last trigger operation refers to a sampling value at room temperature of the thermal property of the heating element in the vaporizer in the last trigger operation. The calibration value is a predicted value at room temperature of the thermal property of the heating element in the vaporizer.

Figure 5:
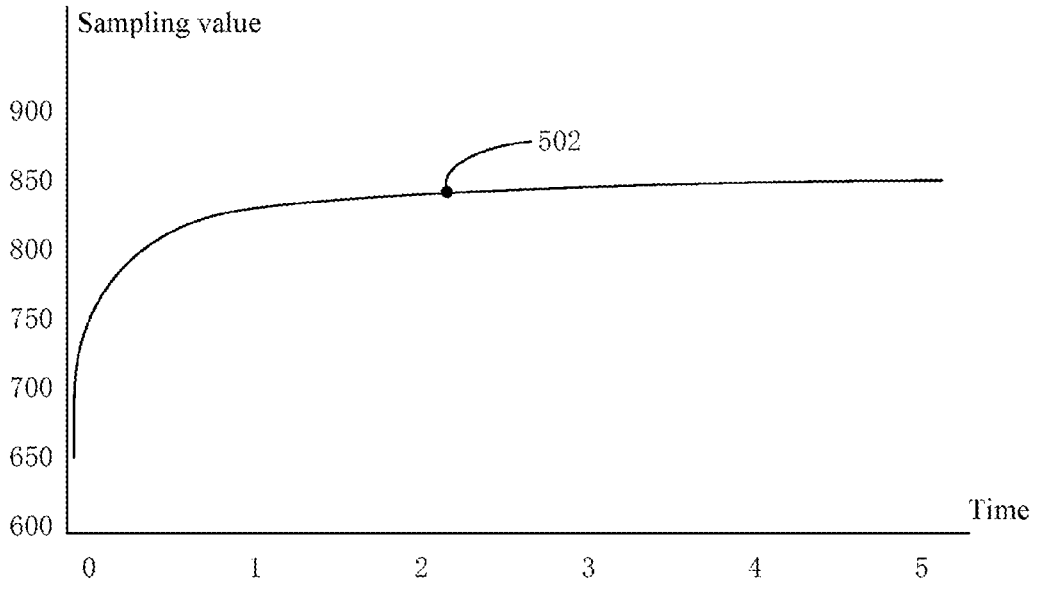
FIG. 5 is a schematic diagram of sampling values in a process in which a vaporizer reaches thermal equilibrium in an embodiment.

It can be understood that, the sampling value of the thermal property of the heating element at room temperature is small before the trigger operation of the vaporizer, and the sampling value of the thermal property of the heating element is large when the vaporizer reaches thermal equilibrium. FIG. 5 shows the sampling values of the thermal property of the heating element in the vaporizer during a trigger operation. During a trigger operation, the sampling value of the thermal property of the heating element increases first, and then stabilized. 502 is a point when the vaporizer reaches the stabilization, and the corresponding sampling value at this point is the stable value.

During the last trigger operation, when the sampling value of the thermal property of the heating element in the vaporizer obtained in a starting period of time is greater than or equal to the calibration value, it is indicated that after the vaporizer reaches thermal equilibrium through the trigger operation before a certain period of time, the heating element is in a cooled state, and the sampling value of the thermal property of the heating element is still greater than the calibration value of the heating element at room temperature, and thus, the calibration value is taken as the initial value of the last trigger operation.

During the last trigger operation, when the sampling value of the thermal property of the heating element in the vaporizer is less than the calibration value, it is indicated that the sampling value can be taken as the sampling value of the thermal property of the heating element at room temperature. Therefore, the sampling value that is less than the calibration value is taken as the initial value of the last trigger operation.

In an embodiment, during the current trigger operation, the initial value of the current trigger operation can be determined, so as to determine, according to the initial value of the current trigger operation and the stable value of the current trigger operation, the trigger increment value of the current trigger operation, which is used to determine the second output power before the vaporizer reaches thermal equilibrium during a next trigger operation.

In this embodiment, the calibration value is obtained, and the sampling value of the last trigger operation is compared with the calibration value, so that a more accurate initial value of the last trigger operation can be determined.

It is to be understood that, although each step in the flowcharts in FIG. 1 and FIG. 3 is displayed sequentially according to arrows, the steps are not necessarily performed according to an order indicated by arrows. Unless otherwise explicitly specified in this application, performing of the steps is not strictly limited, and the steps may be performed in other orders. Furthermore, at least some steps in FIG. 1 and FIG. 3 may include a plurality of sub-steps or a plurality of stages. The sub-steps or stages are not necessarily performed at the same moment, and may be performed at different moments. The sub-steps or stages are not necessarily performed in order, and may be performed in turn or alternately with other steps or at least some of sub-steps or stages of other steps.

Figure 6:
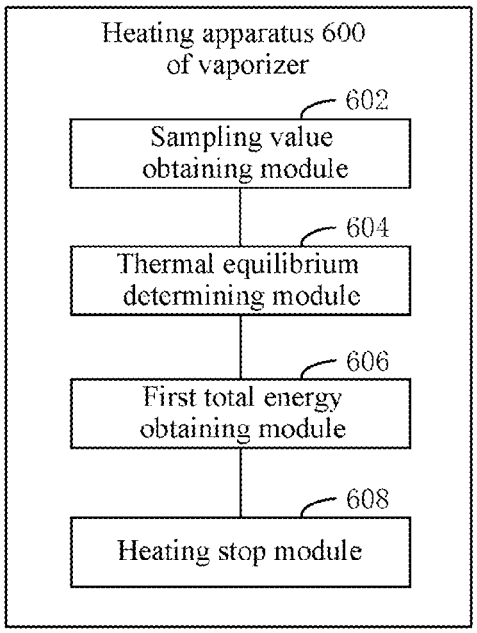
FIG. 6 is a structural block diagram of an apparatus for heating a vaporizer in an embodiment.

In an embodiment, as shown in FIG. 6, an apparatus 600 for heating a vaporizer is provided, including: a sampling value obtaining module 602, a thermal equilibrium determining module 604, a first output power obtaining module 606, and a heating stopping module 608.

The sampling value obtaining module 602 is configured to obtain, in real time, a sampling value of the thermal property of the heating element in the vaporizer when a trigger operation is detected.

The thermal equilibrium determining module 604 is configured to determine whether the vaporizer reaches thermal equilibrium according to a sampling value obtained based on the current moment.

The first output power obtaining module 606 is configured to, when it is determined that the vaporizer reaches thermal equilibrium, take the sampling value of the thermal property of the heating element as the stable value when thermal equilibrium is reached, control the difference value between the sampling value of the heating element and the stable value to be within a first range, and obtain a first output power of the vaporizer in real time.

The heating stopping module 608 is configured to stop heating the heating element when the first output power is less than a first power threshold.

In the aforementioned method and apparatus for heating the vaporizer, the computer device, and the storage medium, a sampling value of the thermal property of the heating element in the vaporizer is obtained in real time when a trigger operation is detected; whether the vaporizer reaches thermal equilibrium is determined according to a sampling value obtained based on the current moment; when it is determined that the vaporizer reaches thermal equilibrium, a sampling value of the thermal property of the heating element is taken as a stable value when thermal equilibrium is reached, the difference value between the sampling value of the heating element and the stable value is controlled to be within a first range, and a first output power of the vaporizer is obtained in real time; the difference value between the sampling value of the heating element and the stable value is controlled to be within the first range, that is, the energy absorbed by the heating element is controlled to be stable within a certain range; and the first output power is less than a first power threshold, indicating that the energy absorbed by a material to be heated in the vaporizer decreases, in other words, the material to be heated in the vaporizer, that is, an object heated for vaporization, is insufficient, so the heating of the heating element is stopped, which prevents the dry burning of the vaporizer, and extends the service life of the vaporizer. Further, the method for heating the vaporizer introduces a process of self-learning, that is, a process of obtaining the stable value, whenever the trigger operation is detected, so that the trigger increment value is dynamically adjusted along with the operating of the vaporizer, and thus the vaporizer automatically adapts to a vaporization temperature range of the material to be heated, thereby ensuring that the vaporizer works accurately and stably.

In an embodiment, the thermal equilibrium determining module 604 is further configured to obtain, based on the current moment, sampling values in a first duration, the first duration including the current moment; and to determine that the vaporizer reaches thermal equilibrium when each of the sampling values in the first duration conforms to a first predetermined rule.

In an embodiment, the thermal equilibrium determining module 604 is further configured to obtain sampling values in a second duration when each of the sampling values in the first duration does not conform to the first predetermined rule, the second duration being greater than the first duration, and the second duration including the current moment; and to determine that the vaporizer reaches thermal equilibrium when each of the sampling values in the second duration conforms to a second predetermined rule.

In an embodiment, the heating stopping module 608 is further configured to obtain a trigger increment value of a last trigger operation, and a maximum value of the thermal property of the heating element in the last trigger operation; to determine, in real time, the first difference value between the sampling value and the maximum value of the thermal property of the heating element in the last trigger operation; when the first difference value is greater than the trigger increment value, to obtain a reference value, control the difference value between the sampling value of the thermal property of the heating element and the reference value to be within a second range, and obtain a second output power of the vaporizer in real time, the reference value being less than or equal to the maximum value of the thermal property of the heating element in the last trigger operation; and to stop heating the heating element when the second output power is less than a second power threshold.

In an embodiment, the reference value is one of the minimum value of the thermal property of the heating element in the last trigger operation, the average value of the thermal property of the heating element in the last trigger operation, or the maximum value of the thermal property of the heating element in the last trigger operation.

Obtaining the minimum value of the thermal property of the heating element in the last trigger operation includes: obtaining the stable values of the thermal property of the heating element for individual trigger operations; and taking the minimum stable value among the stable values as the minimum value of the thermal property of the heating element in the last trigger operation.

The average value of the thermal property of the heating element in the last trigger operation includes: obtaining the stable values of the thermal property of the heating element for individual trigger operations; and determining the average value based on the stable values, and taking the average value as the average value of the thermal property of the heating element in the last trigger operation.

Obtaining the maximum value of the thermal property of the heating element in the last trigger operation includes: obtaining the stable values of the thermal property of the heating element for individual trigger operations; and taking the maximum stable value among the stable values as the maximum value of the thermal property of the heating element in the last trigger operation.

In an embodiment, the heating stopping module 608 is further configured to obtain the initial value of the last trigger operation and the stable value of the last trigger operation; and to determine the trigger increment value of the last trigger operation according to the initial value of the last trigger operation and the stable value of the last trigger operation.

In an embodiment, the apparatus 600 for heating the vaporizer further includes a target parameter determining module configured to obtain a reference stable value and a reference protection trigger value, the reference protection trigger value being a threshold of the thermal property of the heating element; and to determine a target parameter according to the reference stable value and the reference protection trigger value. The determining the trigger increment value of the last trigger operation according to the initial value of the last trigger operation and the stable value of the last trigger operation includes: determining the trigger increment value of the last trigger operation according to the target parameter, the initial value of the last trigger operation, and the stable value of the last trigger operation.

In an embodiment, the heating stopping module 608 is further configured to obtain a calibration value; to take the sampling value of the last trigger operation as the initial value of the last trigger operation when the sampling value of the last trigger operation is less than the calibration value; and to take the calibration value as the initial value of the last trigger operation when the sampling value of the last trigger operation is greater than or equal to the calibration value.

For a specific limitation on the apparatus for heating the vaporizer, reference may be made to the limitation on the method for heating the vaporizer above. Details are not described herein again. Each module in the apparatus for heating the vaporizer may be implemented entirely or partially by software, hardware, or a combination thereof. The foregoing modules may be built in or independent of a processor of a computer device in a hardware form, or may be stored in a memory of the computer device in a software form, so that the processor invokes and executes an operation corresponding to each of the foregoing modules.

In an embodiment, a computer device is provided. The computer device may be a terminal, and an internal structure diagram thereof may be shown in FIG. 7. The computer device includes a processor, a memory, a network interface, a display screen, and an input apparatus that are connected by using a system bus. The processor of the computer device is configured to provide computing and control capabilities. The memory of the computer device includes a non-transitory storage medium and an internal memory. The non-transitory storage medium stores an operating system and a computer program. The internal memory provides an environment for running of the operating system and the computer program in the non-transitory storage medium. The network interface of the computer device is configured to communicate with an external terminal through a network connection. The computer program is executed by the processor to implement a method for heating a vaporizer. The display screen of the computer device may be a liquid crystal display screen or an electronic ink display screen. The input apparatus of the computer device may be a touch layer covering the display screen, or may be a key, a trackball, or a touch pad disposed on a housing of the computer device, or may be an external key board, a touch pad, a mouse, or the like.

Figure 7:
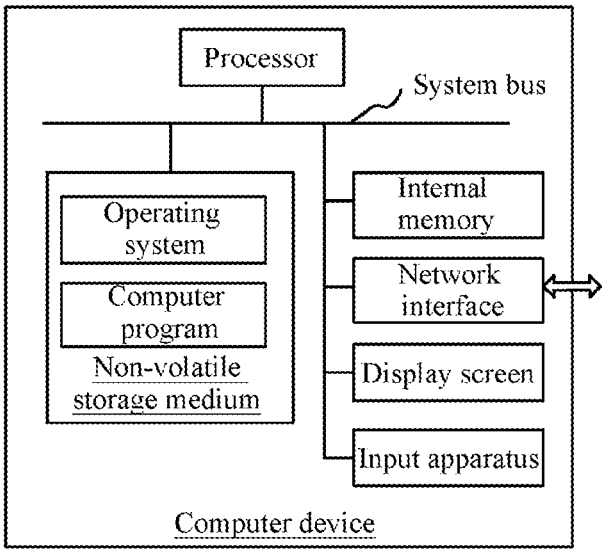
FIG. 7 is an internal structure diagram of a computer device in an embodiment.

A person skilled in the art may understand that, the structure shown in FIG. 7 is only a block diagram of a part of a structure related to a solution of this application and does not limit the computer device to which the solution of this application is applied. Specifically, the computer device may include more or fewer members than those in the drawings, or include a combination of some members, or include different member layouts.

In an embodiment, a computer device is provided, including a memory and a processor. The memory stores a computer program, and the processor, when executing the computer program, implements the steps of the method for heating the vaporizer.

In an embodiment, a computer-readable storage medium is provided, on which a computer program is stored, and the computer program, when executed by a processor, implements the steps of the method for heating the vaporizer.

A person of ordinary skill in the art may understand that all or some of procedures of the method in the foregoing embodiments may be implemented by a computer program instructing relevant hardware. The computer program may be stored in a non-transitory computer-readable storage medium. When the computer program is executed, the procedures of the foregoing method embodiments may be implemented. References to the memory, the storage, the database, or other medium used in the embodiments provided in this application may all include a non-transitory or a transitory memory. The non-transitory memory may include a read-only memory (ROM), a programmable ROM (PROM), an electrically programmable ROM (EPROM), an electrically erasable programmable ROM (EEPROM), or a flash memory. The transitory memory may include a RAM or an external cache. As an illustration instead of a limitation, the RAM is available in a plurality of forms, such as a static RAM (SRAM), a dynamic RAM (DRAM), a synchronous DRAM (SDRAM), a double data rate SDRAM (DDRSDRAM), an enhanced SDRAM (ESDRAM), a synchronous link (Synchlink) DRAM (SLDRAM), a Rambus (Rambus) direct RAM (RDRAM), a direct Rambus dynamic RAM (DRDRAM), and a Rambus dynamic RAM (RDRAM).

Technical features of the foregoing embodiments may be randomly combined. To make description concise, not all possible combinations of the technical features in the foregoing embodiments are described. However, the combinations of these technical features shall be considered as falling within the scope recorded by this specification provided that no conflict exists.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A method for heating a vaporizer, comprising:

obtaining, in real time at a current moment, a sampling value of a thermal property of a heating element in the vaporizer upon detecting a trigger operation;

determining whether the vaporizer reaches thermal equilibrium according to the sampling value obtained based on the current moment;

upon determining that the vaporizer reaches thermal equilibrium, taking the sampling value of the thermal property of the heating element as a stable value, controlling a difference value between the sampling value of the heating element and the stable value to be within a first range, and obtaining, in real time, a first output power of the vaporizer; and stopping heating the heating element when the first output power is less than a first power threshold, wherein, prior to the taking the sampling value of the heating element as the stable value when thermal equilibrium is reached upon determining that the vaporizer reaches thermal equilibrium, the method further comprises:

obtaining a trigger increment value of a last trigger operation, and a maximum value of the thermal property of the heating element in the last trigger operation;

determining, in real time, a first difference value between the sampling value and the maximum value of the thermal property of the heating element in the last trigger operation;

when the first difference value is greater than the trigger increment value, obtaining a reference value, controlling a difference value between the sampling value of the thermal property of the heating element and the reference value to be within a second range, and obtaining, in real time, a second output power of the vaporizer, the reference value being less than or equal to the maximum value of the thermal property of the heating element in the last trigger operation; and stopping heating the heating element when the second output power is less than a second power threshold.

2. The method of claim 1, wherein the determining whether the vaporizer reaches thermal equilibrium according to the sampling value obtained based on the current moment comprises:

obtaining, based on the current moment, sampling values in a first duration, the first duration comprising the current moment; and determining that the vaporizer reaches thermal equilibrium when each sampling value of the sampling values in the first duration conforms to a first predetermined rule.

3. The method of claim 2, wherein the first predetermined rule is that each sampling values of the sampling values in the first duration is a same sampling value, or that difference values between any two sampling values of the sampling values in the first duration are within a preset range.

4. The method of claim 2, further comprising:

obtaining sampling values in a second duration when each sampling value of the sampling values in the first duration does not conform to the first predetermined rule, the second duration being greater than the first duration, the second duration comprising the current moment; and determining that the vaporizer reaches thermal equilibrium when each sampling value of the sampling values in the second duration conforms to a second predetermined rule.

5. The method of claim 4, wherein the second predetermined rule is that the sampling values in the second duration increase one by one in a time order, and a maximum difference value among difference values between two adjacent sampling values of the sampling values in the second duration is less than a difference value threshold, or the second predetermined rule is that the sampling values in the second duration increase one by one in a time order before becoming constant.

6. The method of claim 1, wherein obtaining the maximum value of the thermal property of the heating element in the last trigger operation comprises:

obtaining stable values of the thermal property of the heating element for individual trigger operations; and taking a maximum stable value among the stable values as the maximum value of the thermal property of the heating element in the last trigger operation.

7. The method of claim 1, wherein the reference value is one of: a minimum value of the thermal property of the heating element in the last trigger operation, an average value of the thermal property of the heating element in the last trigger operation, or a maximum value of the thermal property of the heating element in the last trigger operation.

8. The method of claim 1, wherein the obtaining the trigger increment value of the last trigger operation comprises:

obtaining an initial value of the last trigger operation, and a stable value of the last trigger operation; and determining the trigger increment value of the last trigger operation according to the initial value of the last trigger operation and the stable value of the last trigger operation.

9. The method of claim 8, further comprising:

obtaining a reference stable value and a reference protection trigger value, the reference protection trigger value being a threshold of the thermal property of the heating element; and determining a target parameter according to the reference stable value and the reference protection trigger value, wherein the determining the trigger increment value of the last trigger operation according to the initial value of the last trigger operation and the stable value of the last trigger operation comprises:

determining the trigger increment value of the last trigger operation according to the target parameter, the initial value of the last trigger operation, and the stable value of the last trigger operation.

10. The method of claim 8, wherein the obtaining the initial value of the last trigger operation comprises:

obtaining a calibration value;

taking a sampling value of the last trigger operation as the initial value of the last trigger operation when the sampling value of the last trigger operation is less than the calibration value; and taking the calibration value as the initial value of the last trigger operation when the sampling value of the last trigger operation is greater than or equal to the calibration value.

11. The method of claim 1, wherein the thermal property of the heating element comprises a resistance value of the heating element or a temperature of the heating element.

12. The method of claim 1, wherein the trigger operation comprises an inhalation operation, a press operation, a click operation, or a slide operation.

13. The method of claim 1, wherein the stopping heating the heating element when the first output power is less than the first power threshold comprises:

upon detecting that the first output power is less than the first power threshold, cutting off a power supply of the vaporizer to stop the vaporizer from heating the heating element; or upon detecting that the first output power is less than the first power threshold, cutting off a power supply of the heating element to stop heating the heating element.

14. The method of claim 1, further comprising:

upon determining that the vaporizer does not reach thermal equilibrium, when the current trigger operation is not the first trigger operation, obtaining a further trigger increment value;

when the first difference value is less than or equal to the further trigger increment value, determining a further reference value and obtaining a second third output power; and when the second third output power is less than a second third power threshold, stopping heating the heating element.

15. An apparatus for heating a vaporizer, comprising:

a sampling value obtaining module configured to obtain, in real time at a current moment, a sampling value of a thermal property of a heating element in the vaporizer upon detection of a trigger operation;

a thermal equilibrium determining module configured to determine whether the vaporizer reaches thermal equilibrium according to the sampling value obtained based on the current moment;

a first output power obtaining module configured to, upon determination that the vaporizer reaches thermal equilibrium, take the sampling value of the thermal property of the heating element as a stable value, control a difference value between the sampling value of the heating element and the stable value to be within a first range, and obtain, in real time, a first output power of the vaporizer; and a heating stopping module configured to:

stop heating the heating element when the first output power is less than a first power threshold, and prior to taking a sampling value upon determining that the vaporizer reaches thermal equilibrium;

obtain a trigger increment value of a last trigger operation, and a maximum value of the thermal property of the heating element in the last trigger operation, determine, in real time, a first difference value between the sampling value and the maximum value of the thermal property of the heating element in the last trigger operation, when the first difference value is greater than the trigger increment value, obtain a reference value, control a difference value between the sampling value of the thermal property of the heating element and the reference value to be within a second range, and obtain, in real time, a second output power of the vaporizer, the reference value being less than or equal to the maximum value of the thermal property of the heating element in the last trigger operation, and stop heating the heating element when the second output power is less than a second power threshold.

16. A computer device, comprising:

a memory storing a computer program; and a processor configured to implement the method of claim 1 upon execution of the computer program.

17. One or more non-transitory computer-readable mediums having processor-executable instructions stored thereon, wherein the processor-executable instructions, when executed, facilitate the method of claim 1.

* * * * *